US012799851B2

(12) United States Patent
Samman et al.

(10) Patent No.: US 12,799,851 B2
(45) Date of Patent: Nov. 17, 2026

(54) AUTONOMOUS RESTRICTED ORIFICE FOR ANNULAR SAFETY IN GAS LIFT OPERATIONS

(71) Applicant: SAUDI ARABIAN OIL COMPANY, Dhahran (SA)

(72) Inventors: Suhail Abdullah Samman, Riyadh (SA); Ammal Fannoush Al-Anazi, Dammam (SA); James Ohioma Arukhe, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 362 days.

(21) Appl. No.: 18/501,417

(22) Filed: Nov. 3, 2023

(65) Prior Publication Data

US 2025/0146391 A1 May 8, 2025

(51) Int. Cl.
*E21B 43/12* (2006.01)
*E21B 34/16* (2006.01)

(52) U.S. Cl.
CPC ..... *E21B 43/123* (2013.01); *E21B 34/16* (2013.01)

(58) Field of Classification Search
CPC ..... E21B 43/123; E21B 43/122; E21B 43/00; E21B 43/12; E21B 43/121; E21B 34/02; E21B 34/16
See application file for complete search history.

(56) References Cited

U.S. PATENT DOCUMENTS

| | | | |
|---|---|---|---|
| 3,212,517 | A | 10/1965 | Canalizo |
| 5,634,522 | A | 6/1997 | Hershberger |
| 6,629,566 | B2 | 10/2003 | Liknes |
| 8,302,684 | B2 | 11/2012 | Eken |

(Continued)

FOREIGN PATENT DOCUMENTS

| | | | |
|---|---|---|---|
| WO | 02/059485 | A1 | 8/2002 |
| WO | 2007/089933 | A1 | 8/2007 |

OTHER PUBLICATIONS

Gilbertson, Eric, "Gas Lift Valve Failure Mode Analysis and the Design of a Thermally-Actuated Positive-Locking Safety Valve"; A thesis submitted to the Department of Mechanical Engineering in parital fulfillment of the requirements for the degree of Masters of Science in Mechanical Engineering; Massachusetts Institute of Technology; pp. 2-135; Jun. 2010 (135 pages).

(Continued)

*Primary Examiner* — Kelsey E Cary
(74) *Attorney, Agent, or Firm* — Osha Bergman Watanabe & Burton LLP

(57) ABSTRACT

System and method related to a gas lift system in a well having a wellhead. The system includes tubing disposed in casing in the well defining a tubing-casing annulus (TCA), a TCA valve installed on the wellhead coupled to the tubing and casing configured to control a fluid flow from the TCA to the tubing, a line coupled to the TCA valve configured to inject fluid into the TCA, and a restrictive orifice hydraulically connecting a cavity in the TCA valve to the line. The restrictive orifice includes an aperture configured to restrict (Continued)

the flow of the fluid through the line. The method includes running tubing inside casing in the well, installing the TCA valve to the wellhead to the line, opening the TCA valve to flow the fluid from the line to the TCA and into the tubing, and restricting the fluid flow via the restrictive orifice.

19 Claims, 7 Drawing Sheets

(56) References Cited

U.S. PATENT DOCUMENTS

| | | | | |
|---|---|---|---|---|
| 9,376,875 | B2 | 6/2016 | Reitsma et al. | |
| 10,077,642 | B2 | 9/2018 | Elmer | |
| 10,655,439 | B2 | 5/2020 | Murdoch et al. | |
| 2008/0179063 | A1* | 7/2008 | Smith | E21B 43/122 166/252.1 |
| 2009/0288839 | A1 | 11/2009 | Eriksen et al. | |
| 2012/0227983 | A1* | 9/2012 | Lymberopoulos | E21B 34/10 166/373 |
| 2015/0027722 | A1* | 1/2015 | Al-Mulhem | E21B 43/121 166/372 |
| 2017/0183944 | A1* | 6/2017 | Kuykendall | E21B 43/123 |
| 2021/0062926 | A1* | 3/2021 | Haines | E21B 43/123 |
| 2021/0293123 | A1* | 9/2021 | Watson | E21B 43/12 |
| 2022/0243555 | A1 | 8/2022 | Al-Abdulmohsin et al. | |
| 2022/0389809 | A1 | 12/2022 | Al-Mohsen et al. | |

OTHER PUBLICATIONS

Newton, Daniel et al., "Surface Safety System Enhances Gas Lift Safety and Optimizes Surface Line Architecture on Island Wells"; Proceedings of the Abu Dhabi International Petroleum Exhibition and Conference; Paper No. SPE-171748-MS; pp. 1-11; Nov. 10, 2014 (11 pages).

Prasad, Vivek et al., "Improve Integrity of Blowdown Lines Using Innovative Approach to Estimate Cold Temperature Creep"; Proceedings of the Abu Dhabi International Petroleum Exhibition & Conference; Paper No. SPE-188707-MS; pp. 1-15; Nov. 13, 2017 (15 pages).

Shahri, Mehdi Abbaszadeh, "Simplified and Rapid Method for Determining Flow Characteristics of Every Gas-List Valve (GLV)"; A dissertation in Petroleum Engineering submitted to the Graduate Faculty of Texas Tech University in partial fulfullment of the requirements for the degree of Doctor of Philisophy in Petroleum Engineering; pp. ii-112; Aug. 2011 (128 pages).

* cited by examiner

AUTONOMOUS RESTRICTED ORIFICE FOR ANNULAR SAFETY IN GAS LIFT OPERATIONS

BACKGROUND

Hydrocarbon fluids are often found in hydrocarbon reservoirs located in porous rock formations far below the earth's surface. Production wells may be drilled to extract the hydrocarbon fluids from the hydrocarbon reservoirs. Often, hydrocarbon fluids are able to flow naturally through production wells because the pressure within the reservoir is high enough to encourage the hydrocarbons to the surface. However, when a reservoir becomes depleted, or is naturally a reservoir with low-pressure, gas-lift may be utilized to produce the hydrocarbon fluids.

In gas lift operations, it is common for uncontrolled release of pressurized gas from wells into the atmosphere to occur if there is a leak in the system. Conventional gas lift wells include downhole components such as orifices and unloading valves and surface components such as Christmas Trees and tubing-casing annulus (TCA) valves. Uncontrolled release of pressurized gas may occur due to a leak between the TCA valve and a check valve. When a leak occurs between the TCA valve and a check valve, the TCA valve alone cannot prevent an uncontrolled release of pressurized gas into the atmosphere.

Accordingly, there exists a need for a system for preventing gas leaks, minimizing risk of equipment damage, and providing warning for potential issues in the gas lift system. A restrictive orifice connected to the TCA valve is used to create a pressure drop in the line between the TCA valve and the TCA by controlling the flow of fluid. A pressure drop in the line may prevent gas leaks from occurring.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for a gas lift system in a well having a wellhead. The system includes a tubing disposed in a casing in the well defining a tubing-casing annulus (TCA) in the well, a TCA valve installed on the wellhead coupled to the tubing and the casing configured to control a flow of a fluid from the TCA to the tubing, a line coupled to the TCA valve configured to inject the fluid into the TCA, and a restrictive orifice hydraulically connecting a cavity in the TCA valve to the line, wherein the restrictive orifice comprises an aperture configured to restrict the flow of the fluid through the line.

In one aspect, embodiments disclosed herein relate to a method for a gas lift system in a well having a wellhead. The method includes running a tubing inside a casing in the well defining a tubing-casing annulus (TCA), installing a TCA valve to the wellhead coupled to the tubing and the casing to a line configured to inject a fluid into the TCA, opening the TCA valve to flow the fluid from the line to the TCA and into the tubing, and restricting the fluid flow via a restrictive orifice hydraulically connected to a cavity in the TCA valve and the line. The restrictive orifice includes an aperture for restricting the flow of the fluid through the line.

Other aspects and advantages of the claimed subject matter will be apparent from the following description and the appended claims.

DETAILED DESCRIPTION

Figure 1:
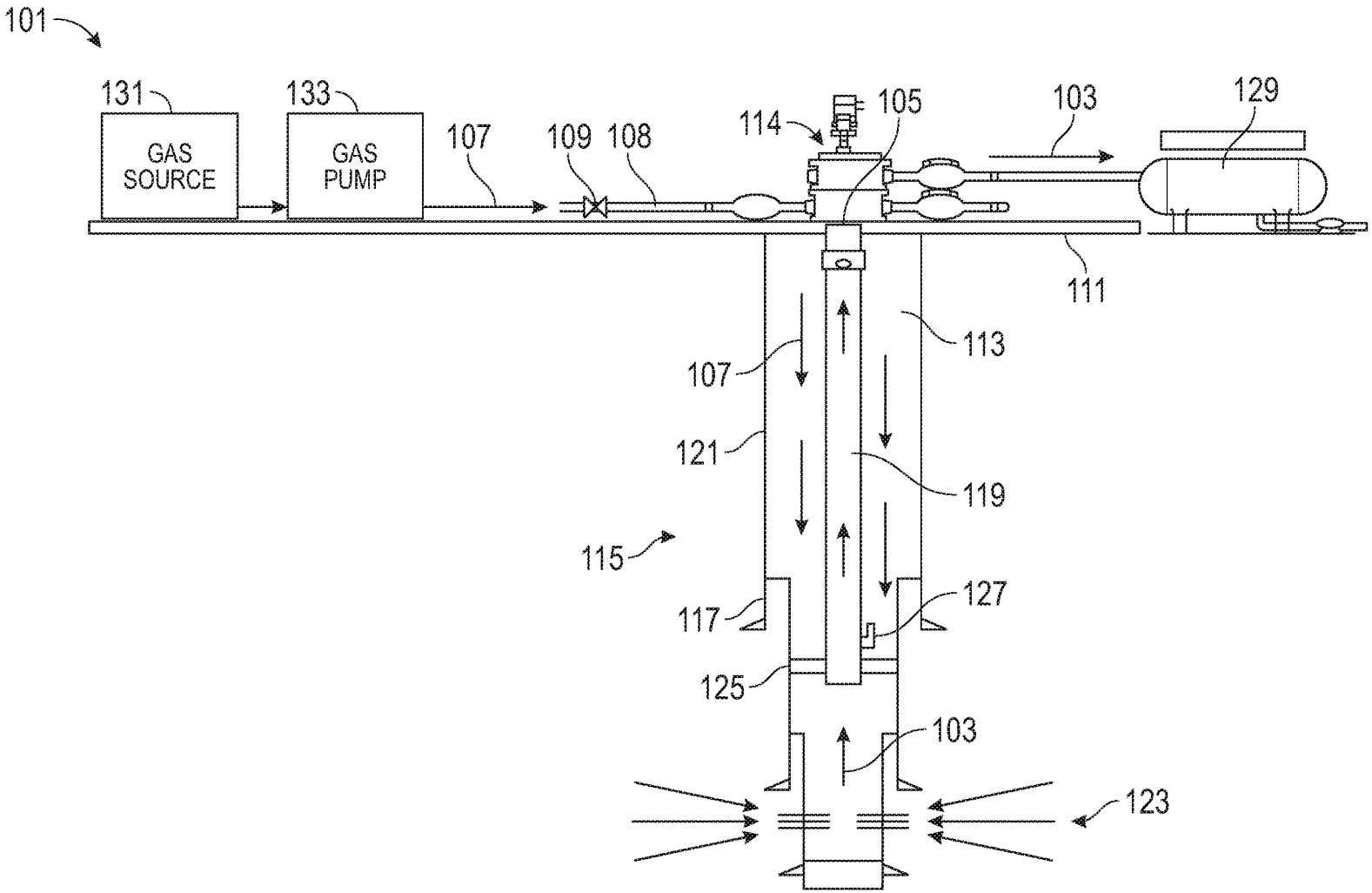
FIG. 1 (Prior Art)
FIG. 1 shows a conventional gas lift system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-8, any component described regarding a figure, in various embodiments disclosed herein, may be equivalent to one or more like-named components described with regard to any other figure. For brevity, descriptions of these components will not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a force applicator" includes reference to one or more of such force applicators.

In one aspect, embodiments disclosed herein relate to a system for a gas lift system in a well. Gas-lift systems aid or increase hydrocarbon production in hydrocarbon production wells by injecting high-pressure gas, from the surface, down a tubing-casing annulus into fluids disposed in the production piping. The fluid density and hydrostatic pressure of the fluid are reduced by the introduction of the injected gas, thereby allowing the in-situ reservoir pressure to lift the lightened fluids. In one or more embodiments, the gas used in a gas-lift system comes from an external source. Well sites using such a gas-lift system are called conventional gas-lift well sites. In other examples of gas-lift systems, the gas comes from the on-site hydrocarbon reservoir from which the well extracts the hydrocarbons. Well sites using such a gas-lift system are called in-situ gas-lift well sites.

In gas-lift operations, tubing-casing annulus integrity is important for maintaining gas injection rate and pressure required to lift fluids to surface. If tubing-casing annulus is compromised, gas injection is reduced negatively impacting lift efficiency and overall production of a well. Additionally, a compromised tubing-casing annulus leads to safety issues, such as potential gas leaks and uncontrolled release of pressurized gas into the atmosphere. Potential gas leaks are a fire hazard. Therefore, it is essential to ensure the integrity of tubing-casing annulus during gas lift operations.

FIG. 1 depicts an example of a conventional gas-lift well site (101). A gas-lift system "lifts" production fluids (103), such as oil, gas, and/or water, to the well exit (105) by lowering the density of the production fluids (103) with high pressure gas (107). In one or more embodiments, the gas (107), commonly nitrogen, is pumped from a gas source (131) using a gas pump (133) and is supplied into the well (115) through a gas injection line (108) with a check valve, such as a surface gas injection valve (109). The gas injection line (108) may be any line capable of transporting gas (107) from the gas source (131) to the well (115). The gas injection line (108) may be coupled to a wellhead (114) on surface (111). The gas source (131) can be of many shapes and sizes. In one or more embodiments, the gas source (131) and gas pump (133) are located near the well site (101), as illustrated in FIG. 1. In other examples, the gas source (131) and gas pump (133) may be located at any distance from the well site (101). The surface gas injection valve (109), disposed at the surface (111) and connected to a tubing-casing annulus (TCA) (113) of the well (115), controls the flow of the gas (107) and injects the gas (107) into the TCA (113) with a user-defined pressure, which can be considered as high, according to one or more embodiments. The TCA (113) consists of the space between the casing (117) and the tubing (119). The TCA (113) is configured to isolate the gas (107), allowing the gas (107) to flow the depth of the well (115) without mixing with other fluids.

The casing (117), disposed in the well (115) against the wellbore (121) and typically formed of a durable material such as steel, extends to a depth above the reservoir (123). The casing (117) isolates the subsurface fluids and supports the wellbore (121), the drilled hole comprising the well (103), up to the depth above the reservoir (123). At the other end, the wellbore (121) extends through the reservoir (123) beneath the casing (117). The reservoir (123) is disposed below the surface (111) of the earth in porous rock formations and is the source of the production fluids (103).

A tubing (119), disposed in the wellbore (121), extends from the well exit (105) to a depth above the reservoir (123) and is a conduit for production fluids (103) to exit the well (115). In one or more embodiments, the tubing (119) may be formed of tempered steel or equivalent. The production fluids (103) may include oil. The oil flows from the reservoir (123) into the wellbore (121), through the casing (117), and into the tubing (119). If the reservoir (123) has enough pressure, the oil travels upwards in the tubing (119) to the surface (111). Conversely, if the reservoir (123) does not have enough pressure to lift the oil by itself, gas (107) is injected into the oil.

In one or more embodiments, the gas-lift well (115) includes a packer (125) disposed around the tubing (119) in the casing (117). The packer (125) may be any packer (125) known in the art capable of scaling the TCA (113). The packer (125) may be used to prevent production fluid (103) from the reservoir (123) from migrating past the packer (125) into the TCA (113). At a given pressure that may be considered as high, the gas (107) enters the tubing (119) through a downhole gas injection valve (127) and mixes with the production fluids (103) disposed in the tubing (119). The downhole gas injection valve (127) forms a hydraulic connection between the TCA (113) and the tubing (119) and is configured to allow the flow of the gas (107) from the TCA (113) into the tubing (119).

In one or more embodiments, the downhole gas injection valve (127) is composed of stainless steel or the equivalent. The injection pressure, combined with the lighter weight of the gas (107), lowers the density of the production fluids (103) until the mixture becomes light enough to flow towards the well exit (105) and into a production tank (129). The production tank (129) is a storage tank, disposed at the surface (111), that collects and stores the production fluids (103) after the production fluids (103) exits the well (115). In some instances, the production fluids (103) may be directly transported to (e.g., by a pipeline), or otherwise processed by, an oil and gas processing facility.

The gas-lift well (115) is operated according to a set of operation parameters, that directly influence the hydrocarbon production. In one or more embodiments, the set of operation parameters includes a gas-lift stability, a gas injection rate, a gas injection pressure, a gas-to-liquid ratio, opening and closing pressures on one or more check valves, and a hydrocarbon production rate. Gas lift stability refers to the ability of a gas-lift system to maintain consistent and efficient operations over time without experiencing issues that could disrupt production. Instabilities in gas-lift operations can lead to reduced production rates, increased operational costs, and potential damage to equipment. A notable example of gas-lift instability is a slug flow, in which large pockets of gas and liquid alternate in the production tubing, causing rapid changes in pressure and flow rates. A slug flow may lead to inefficient lifting, decreased production and wear and tear on well equipment. The gas injection rate is typically balanced in order to create sufficient buoyancy to lift the fluids without causing excessive gas breakout at the surface. Over-injecting gas might lead to inefficient gas usage, while under-injecting gas could result in poor production rates. The gas injection pressure is usually selected to ensure efficient fluid lifting while avoiding gas-lift instabilities. Injecting gas at a too high pressure may lead to gas leak and breakout at the surface, resulting in uncontrolled release of pressurized gas into the atmosphere. Injecting gas at a too low a pressure might not provide enough lifting force to overcome the hydrocarbon reservoir pressure. The gas-to-liquid ratio may also play a significant role in gas-lifted hydrocarbon production, as injecting too much gas may lead to inefficient fluid separation at the surface, while injecting too little gas may result in poor lifting performance. The opening and closing pressures of the surface gas injection valve (109) and the downhole gas injection valve (127) determine when gas injection starts and stops.

However, if a leak occurs between check valves or gas injection valves (127) and valves on the wellhead (114), the injected pressurized gas (107) originally contained in the TCA may be uncontrollably released at a speed, such as supersonic speed. The pressurized gas (107) may have a pressure of around 2500 pounds per square inch (psi). If check valves are shut in to provide control of the pressurized gas (107), the TCA may be pressurized further due to no bleed off mechanism.

Figure 2:
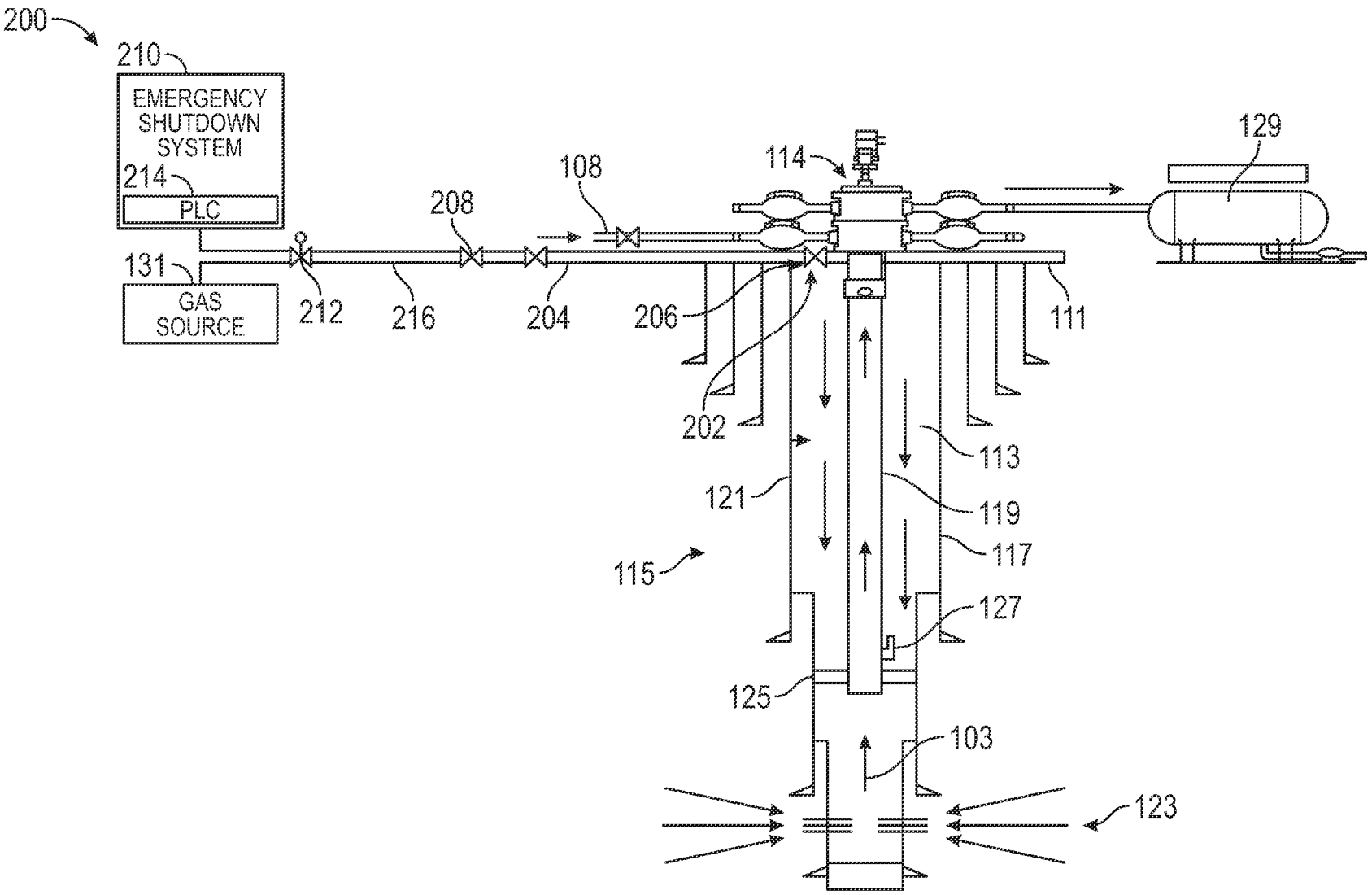
FIG. 2 shows a gas lift system in accordance with one or more embodiments.

FIG. 2 shows a system in accordance with one or more embodiments. Specifically, FIG. 2 shows a gas lift system (200) in a well (115) used in conjunction with some embodiments in FIG. 1. The gas lift system (200) described in FIG. 2 may replace the conventional gas-lift well site (101) in FIG. 1 to prevent uncontrolled release of pressurized gas into the atmosphere. The gas lift system (200) includes a wellhead (114), tubing (119), and casing (117). Tubing (119) is disposed in the casing (117) defining the tubing-casing annulus (TCA) (113) in the well (115). The wellhead (114) includes a TCA valve (202) coupled to the tubing (119) and casing (117). The TCA valve (202) may be any valve capable of controlling fluid (103) flow from the casing (117) through the TCA (113) and into the tubing (119). During operations, the TCA valve (202) remains open to allow pressurized gas (107) to flow from the TCA (113) to the tubing (119). When the TCA valve (202) is closed, the tubing (119) is isolated from the TCA (113) resulting in blocking gas flow in the tubing (119). The TCA valve (202) is coupled to a line (204) used to inject fluids (103) into the TCA (113). The TCA valve (202) may be closed to prevent uncontrolled release of pressurized gas in the atmosphere. The fluids may be gas (e.g., high pressurized gas (107)). The line (204) may be any pipe capable of withstanding high pressure and temperature to transport high pressurized gas (107). In some embodiments, the line (204) is hydraulically connected to the TCA (113) via the TCA valve (202). The line (204) may be connected to a gas source (131) and a gas pump (133). The line (204) may be made of Nickel Alloy material. In such embodiments, the line (204) is a durable and reliable conduit that withstands harsh conditions of gas lift operations, such as high pressures and high temperatures. The line (204) may have a diameter of 2 inches.

The gas lift system (200) further includes a restrictive orifice (206) hydraulically connecting the TCA valve (202) to the line (204). The restrictive orifice (206) is further described in FIG. 5. The restrictive orifice (206) may provide annular safety and guard against uncontrolled gas release from the TCA (113). As gas (107) flows through the line (204), gas (107) flows through the restrictive orifice (206) causing acceleration as gas (107) flows through the restrictive orifice (206). As gas (107) accelerates, flowrate increases, and pressure decreases across the restrictive orifice (206). The gas lift system (200) may include one or more check valves (208), such as the surface injection valve (109) along the line (204) near the TCA valve (202). The restrictive orifice (206) provides a pressure drop to aid in preventing uncontrolled gas release should any leak be detected between the check valve (208) and TCA valve (202). The restrictive orifice (206) may be autonomously operated based on the physics of fluid dynamics. One or more pressure taps may be located on the line (204) before and after the restrictive orifice (206) for measuring the pressure differential across the restrictive orifice (206). Pressure taps may aid in monitoring and controlling the gas lift system (200).

In one or more embodiments, the check valves (208) are distanced from the TCA valve (202) by about 15 feet. Check valves (208) may be one-way valves used for directing fluid flow in one direction by preventing backflow or reverse flow. The high pressurized gas (107) may be injected through the line (204) to flow through the check valve (208) towards the TCA valve (202). The check valve (208) may be automatically actuated based on a pressure differential across the check valve (208). For example, if the pressure upstream from the check valve (208) is greater than the pressure downstream, the check valve (208) automatically opens to allow flow of gas (107) through the check valve (208). If pressures upstream and downstream equalize or reverse, the check valve (208) automatically closes to prevent flow of gas (107) through the check valve (208).

The gas lift system (200) may include an emergency shutdown system (ESD) (210). In some embodiments, the ESD (210) is hydraulically connected to the restrictive orifice (206) in the line (204). The ESD (210) may be any system capable of stopping the flow of fluid in the line (204) by closing the TCA valve (202). The ESD (210) may be controlled manually or automatically. The ESD (210) may include a computer (e.g., computer system (802) further described in FIG. 8). The ESD (210) may include one or more sensors disposed on the line (204) for measuring parameters such as pressure data, flowrate data, and temperature data. The ESD (210) may monitor pressure differential across the restrictive orifice (206). In some embodiments, the ESD (210) is used as a safety mechanism for emergency activation. For example, if pressure differential across the restrictive orifice (206), check valve (208), or TCA valve (202) exceeds a pre-set threshold, the ESD (210) is triggered to stop flow of gas (107). In other embodiments, if measured flow rate surpasses a preset limit, the ESD (210) transmits an alarm. The alarm may alert an operator or user to take corrective action, such as shutting down gas supply. The gas lift system (200) may further include a power-operated emergency isolation valve (ZV) (212) disposed in the line (204). The ESD (210) may be connected to the ZV (212) as illustrated in FIG. 2. The ZV (212) may be any valve capable of shutting down the gas supply via a programmable logic controller (PLC).

The PLC (214) may monitor parameters, such as pressure. A pre-determined pressure differential may be programmed in the PLC (214) for automatic shutdown of the gas supply. The PLC (214) may include the ESD (210). The ZV (212) may be used to protect a larger line supplying gas, such as a gas supply line (216) from a gas source (131). For example, gas supply may be shut down at the ZV (212) preventing gas (107) from flowing from the gas source (131) to the gas supply line (216). The PLC (214) may be programmed to detect any pre-set pressure differential for indication of a leak. In such embodiments, if a leak is detected in the line (204) between the ZV (212) and the TCA valve (202), the ZV (212) may be triggered by the PLC (214) to shut down gas supply into the line (204).

In some embodiments, the check valve (208) is disposed in the line (204) between the TCA valve (202) and the ZV (212). The ESD (210) may interact with any check valve (208) or TCA valve (202) and shut down the check valves (208) and TCA valves (202) to provide control and prevent further pressurization of the TCA (113). In one or more embodiments, the ESD (210) actuates the TCA valve (202) when the pressure differential across the restrictive orifice (206) exceeds the predetermined threshold. In some embodiments, the ESD (210) is directly or indirectly connected to one or more of the components in the gas lift system (200), such as the TCA valve (202), the line (204), the surface gas injection valve (109), and the ZV (212).

Figure 3:
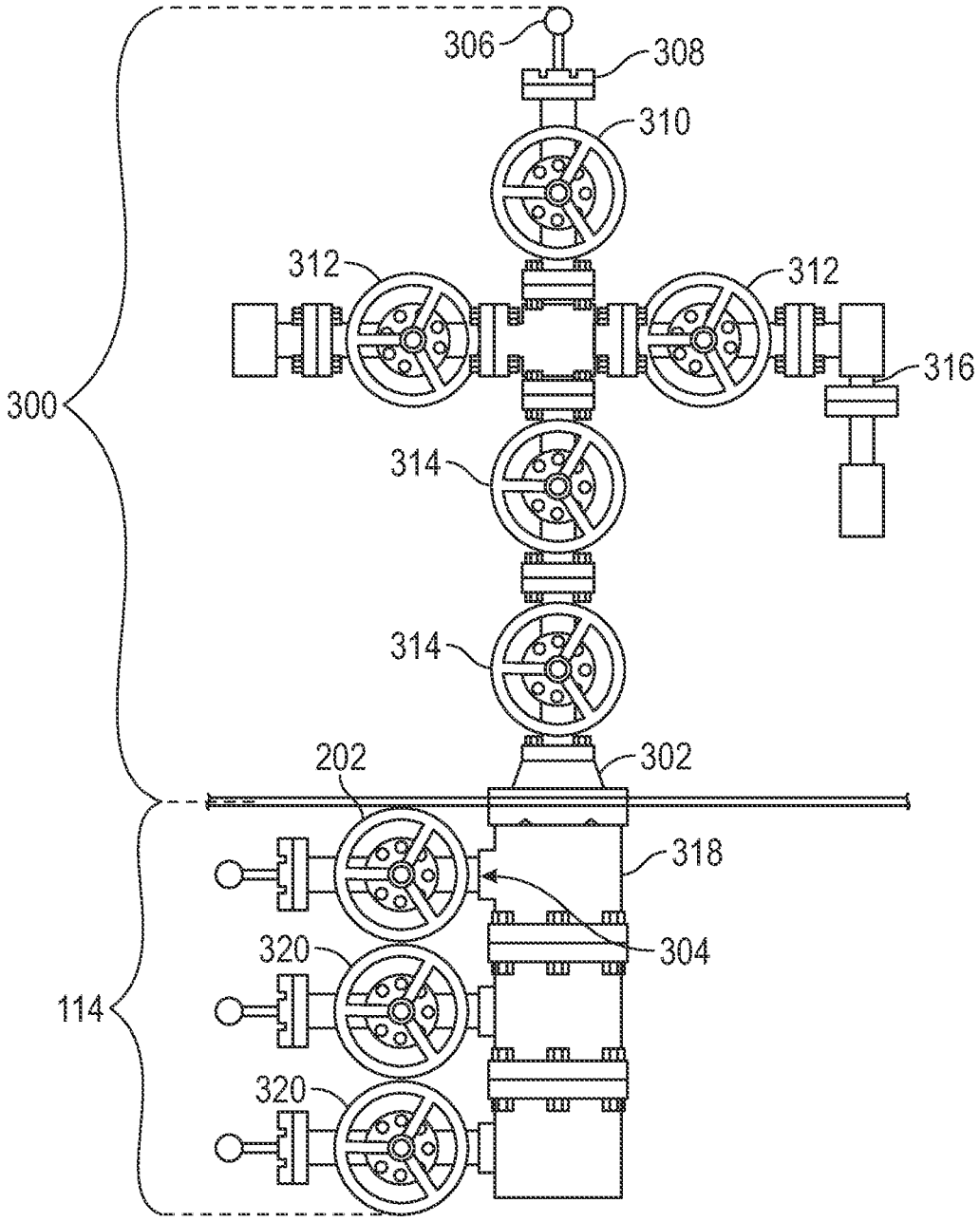
FIG. 3 shows a wellhead and Christmas Tree useful in conjunction with FIG. 2 in accordance with one or more embodiments.

FIG. 3 shows a wellhead (114) and Christmas Tree (300) used in conjunction with FIG. 2 in accordance with one or more embodiments. In one or more embodiments, a Christmas Tree (300) is coupled to the wellhead (114) in the gas lift system (200). The TCA valve (202) may be coupled to tubing (e.g., tubing (119)) using a tubing hanger (302) as shown on the Christmas Tree (300). The tubing hanger (302) may be suspended from the TCA valve (202). A flange (304) may be used to couple the TCA valve (202) to the casing (117). In some embodiments, the Christmas Tree (300) is used for gas injection. In other embodiments, the Christmas Tree (300) may be used to allow production fluid (103) to flow from a well (e.g., well (115)) to the surface. The Christmas Tree (300) may include components such as pressure gauges (306), T-caps (308), swab valves (310), wing valves (312), master valves (314), and chokes (316). A pressure gauge (306) is used for monitoring pressure in the well. A swab valve (310) is commonly disposed at the top of the Christmas Tree (300) to provide vertical access to the well for operations, such as wireline, slickline, or coiled tubing. A T-cap (308) is a flange used to allow wireline lubricator connection to a well for well operations. A wing valve (312) may be used to control or isolate production from the well (115) into any facilities on surface. A master valve (314) may disposed above the tubing hanger (302) for shutting in the well. A choke (316) may be adjustable and used to control production rate in the well.

The wellhead (114) includes the TCA valve (202) coupled to casing (e.g., casing (117)) using a flange. The wellhead (114) may include a tubing head spool (318) for suspending and sealing tubing. The wellhead (114) may further include annulus valves (320) used for connection to either the annulus of tubing (119) or annulus of casing (117) (e.g., TCA (113)).

Figure 4:
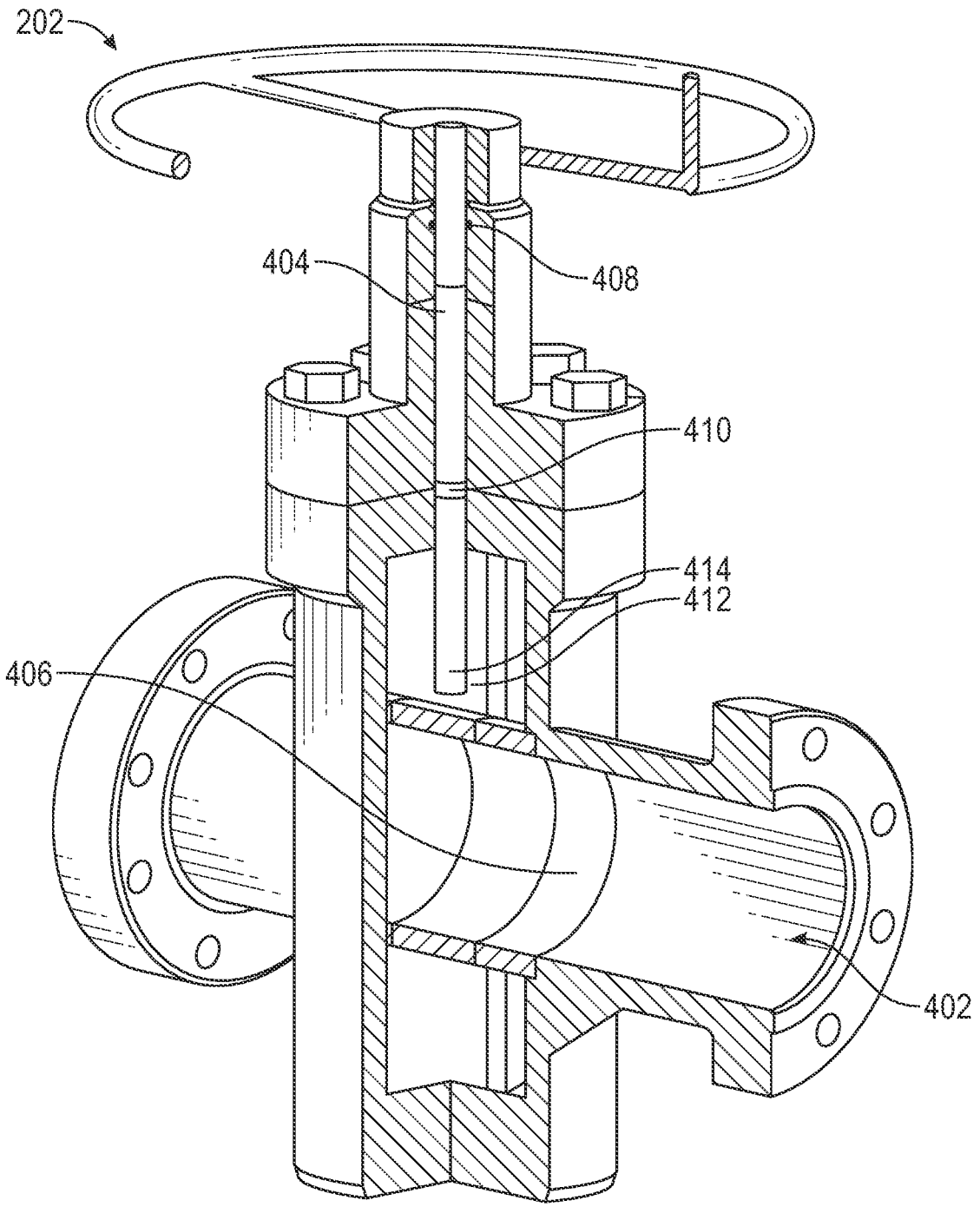
FIG. 4 shows a TCA valve useful in conjunction with FIGS. 2 and 3 in accordance with one or more embodiments.

FIG. 4 shows a schematic of a TCA valve (202) used in conjunction with FIG. 2 in accordance with one or more embodiments. The TCA valve (202) may be any valve capable of controlling flow of fluid between tubing (119) and casing (117) through the TCA (113). The TCA valve (202) includes a cavity (402). The cavity (402) is a chamber or space within the TCA valve (202) designed to manage fluid flow. The TCA valve (202) may include components such as stem packing (404), floating slab gate (406), stem bearing (408), back seating (410), lift nut (412), and non-rising stem (414). Stem packing (404) may be any packing material used as a sealant to prevent liquid leaks in stems of the valve. A floating slab gate (406) may be used to tightly seal the valve using line pressure.

Figure 5:
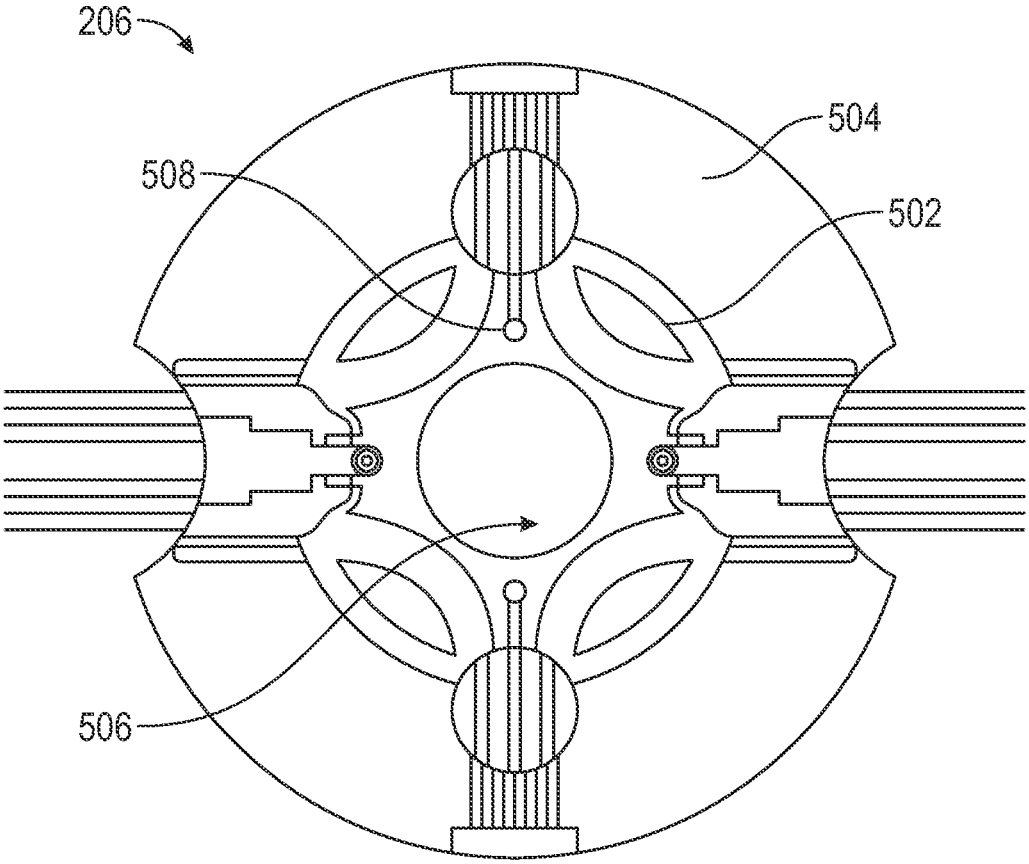
FIG. 5 shows a restrictive orifice useful in conjunction with FIGS. 1-3 in accordance with one or more embodiments.

FIG. 5 shows a cross sectional view of the restrictive orifice (206) used in conjunction with FIGS. 2-4 in accordance with one or more embodiments. The restrictive orifice (206) may be of a circular shape for even flow and pressure distribution. The restrictive orifice (206) may include one or more concentric orifice plates (502) on an orifice plate (504). The orifice plate (504) may be designed to be robust and resistant to wear for longevity and consistent performance. The orifice plate (504) may be housed within a sturdy body made of metal or other durable materials to ensure fluid flows through the orifice plate (504). The restrictive orifice includes an aperture (506) used to restrict the flow of fluid, such as gas (107), through the line (204). The aperture (506) may be in the central part of the restrictive orifice (206). The aperture (506) may be a precision-engineered opening or bore. Fluid and gas may flow through the aperture (506).

As fluid and gas flow through the aperture (506), the acceleration causes a decrease in pressure downstream of the restrictive orifice (206) due to Bernoulli's principle stating an increase in velocity of a fluid is accompanied by a decrease in pressure. Therefore, the small fixed restrictive orifice (206) creates a proportional pressure drop to flow rate using the aperture (506). For example, by restricting the flow using the restrictive orifice (206), a specific amount of fluid may pass through the restrictive orifice (206) ensuring the flowrate remains within operational limits. A pressure drop is then created across the restrictive orifice (206). The size of the orifice plate (504) and aperture (506) may be designed based on desired flow rate, pressure drop, and characteristics of gas or fluid being controlled. For example, a smaller aperture (506) may result in a higher pressure drop and reduced flow rate. Alternatively, a larger aperture (506) may allow for higher flowrate with a lower pressure drop. The design of the restrictive orifice (206) may be based on ensuring effective prevention of uncontrolled gas release.

The ESD (210) described in FIG. 2 may be connected directly to the restrictive orifice (206) for quick and safe stopping of gas flow in case of an emergency. The restrictive orifice (206) may include a pressure sensor (508) for measuring and monitoring pressure differential across the restrictive orifice (206). The pressure sensor (508) may provide pressure differential data used to calculate flow rate or detect anomalies. The restrictive orifice (206) does not require an external power source. The restrictive orifice (206) may be made of materials capable of withstanding high pressures, high temperatures, and corrosive environments typically encountered in gas lift systems (200). The restrictive orifice (206) may be made of materials such as stainless steel, Nickel Alloy, or similar corrosion-resistant alloys increasing reliability and longevity. The restrictive orifice (206) aids in precise flow rate control by relying on pressure differentials.

The restrictive orifice (206) is fluidly connected to the cavity (402) of the TCA valve (202). The restrictive orifice (206) may include a sealing mechanism, such as a gasket or O-ring, placed around the restrictive orifice (206) to connect to the line (204) and TCA valve (202). The sealing mechanism may be used to prevent leaks and ensure fluid only flows through the restrictive orifice (206). The restrictive orifice (206) may include flanges or threaded connections on both ends for installation and connection to the line (204) or equipment. The restrictive orifice (206) may connect to the ESD (210) to provide an extra layer of safety for the gas lift system (200) for preventing accidents and damage. For example, in case of an emergency, the ESD (210) shuts down the gas supply and the restrictive orifice (206) regulates the flow of gas through the line (204). By regulating the flow of gas through the line (204), gas is prevented from escaping. Escaped gas may cause harm to people, the environment, and/or equipment. Shutting down the gas supply using the ESD (210) minimizes the risk of equipment damage and explosion. By connecting the restrictive orifice (206) to the ESD (210), the ESD (210) is able to monitor flow rate of gas in the line (204). In such embodiments, a predetermined flowrate threshold may be programmed in the ESD (210) to transmit an alarm indicating an issue in the line (204) or gas lift system (200). Operators may take corrective action using the early warning of the alarm to prevent further damage and accidents.

In one or more embodiments, the restrictive orifice (206) includes an indicator, such as an arrow, illustrating the intended direction of flow. The indicator may instruct a user on how to install the restrictive orifice (206) correctly in the line (204).

Figure 6:
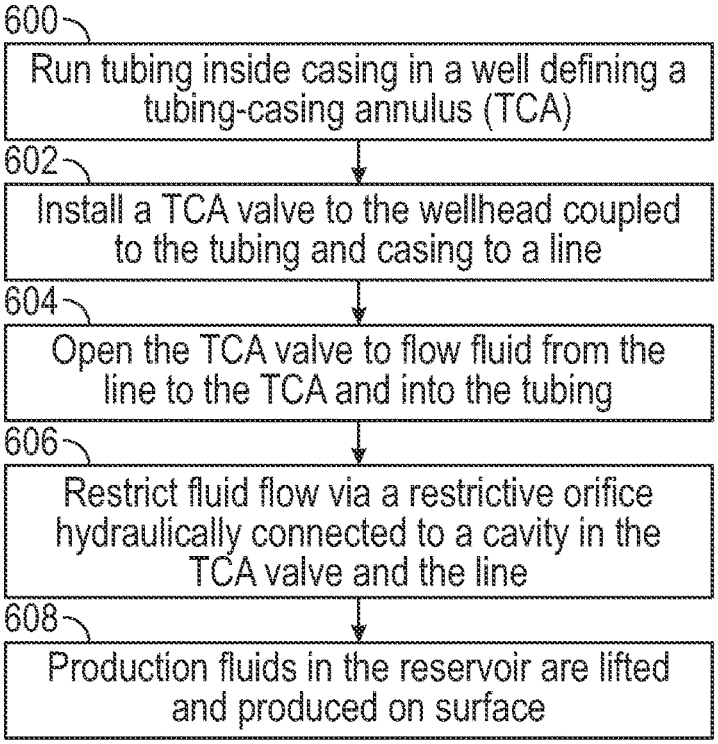
FIG. 6 shows a flow chart in accordance with one or more embodiments.

FIG. 6 shows a flowchart in accordance with one or more embodiments. Specifically, FIG. 6 describes a general method for a gas lift system in a well with a wellhead. One or more blocks in FIG. 6 may be performed by one or more components (e.g., gas lift system (200)) as described in FIGS. 1-5. While the various blocks in FIG. 6 are presented and described sequentially, one or ordinary skill in the art will appreciate that some or all of the blocks may be executed in different orders, may be combined or omitted, and some or all of the blocks may be executed in parallel. Furthermore, the blocks may be performed actively or passively.

In Block 600, tubing is run inside casing in a well to define a tubing-casing annulus (TCA). In Block 602, a TCA valve is installed to the wellhead coupled to the tubing and casing to a line. The TCA valve may be coupled to the tubing via a tubing hanger and to the casing via a flange. The line is a pipeline that injects fluid into the TCA. The line may be made of Nickel Alloy material for withstanding high pressure and high temperature conditions. In Block 604, the TCA valve is opened to flow fluid from the line to the TCA and into the tubing. The fluid may include gas. In Block 606, fluid flow is restricted via a restrictive orifice hydraulically connected to a cavity in the TCA valve and the line. The restrictive orifice includes an aperture for restricting the flow of fluid through the line. The flowrate of the fluid increases as the fluid flows through the restrictive orifice causing a pressure drop. The pressure drop across the restrictive orifice may prevent a leak and uncontrolled release of pressurized gas. In Block 608, production fluids in the reservoir are lifted and produced on surface.

Figure 7:
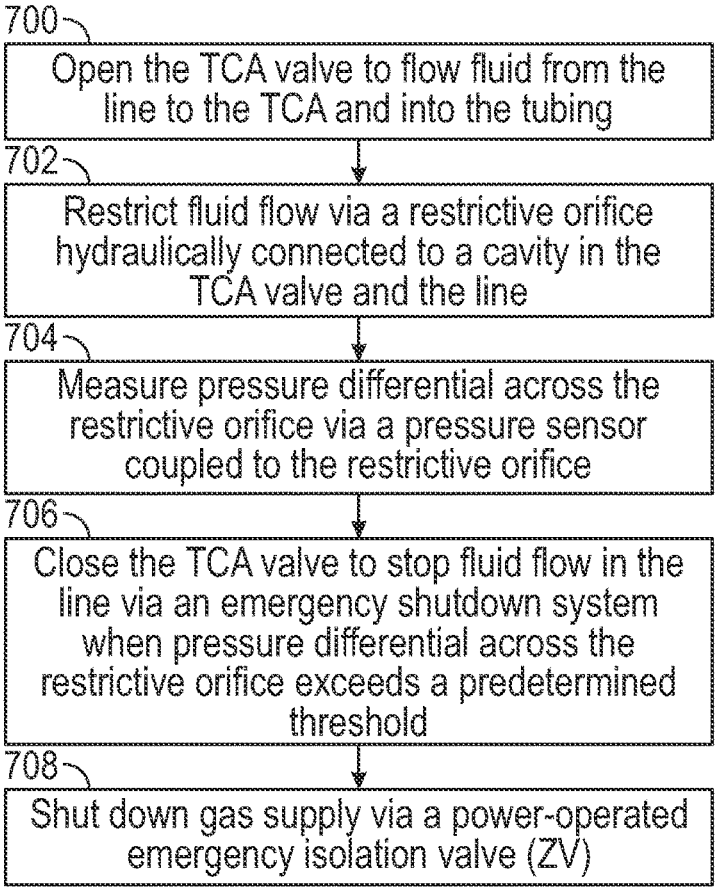
FIG. 7 shows a flow chart in accordance with one or more embodiments.

FIG. 7 shows a flowchart in accordance with one or more embodiments. Specifically, FIG. 7 further expands on the method described in FIG. 6. One or more blocks in FIG. 7 may be performed by one or more components (e.g., gas lift system (200)) as described in FIGS. 1-5. While the various blocks in FIG. 7*are* presented and described sequentially, one or ordinary skill in the art will appreciate that some or all of the blocks may be executed in different orders, may be combined or omitted, and some or all of the blocks may be executed in parallel. Furthermore, the blocks may be performed actively or passively.

Expanding on Block 600, in Block 700, the TCA valve is opened to flow fluid from the line through the TCA and into the tubing. Fluid may be gas. Fluid may be directed in one direction to prevent reverse flow by using a check valve in the line. Fluid flow may be directed in one direction by automatically actuating the check valve based on the pressure differential across the check valve. A gas injection line may be coupled to the wellhead to inject gas into the well.

Expanding on Block 606, in Block 702, fluid flow is restricted via a restrictive orifice hydraulically connected to a cavity in the TCA valve and the line. In Block 704, pressure differential across the restrictive orifice is measured via a pressure sensor coupled to the restrictive orifice. In Block 706, the TCA valve is closed to stop fluid flow in the line via an ESD when pressure differential across the restrictive orifice exceeds a predetermined threshold. The predetermined threshold may be preset in the ESD. The predetermined threshold may be a value indicating a leak in the line. The ESD may include a sensor disposed on the line to measure parameters such as pressure data, flowrate data, and temperature data.

In Block 708, gas supply is shut down via a ZV disposed in the line. The ZV may be actuated by a PLC designed to monitor the parameters measured by one or more sensors on the line. The PLC may include the ESD. Gas supply may include a larger pipeline coupled to the ZV. A check valve may be disposed between the TCA valve and the ZV in the line to direct fluid in one direction and prevent backflow.

Figure 8:
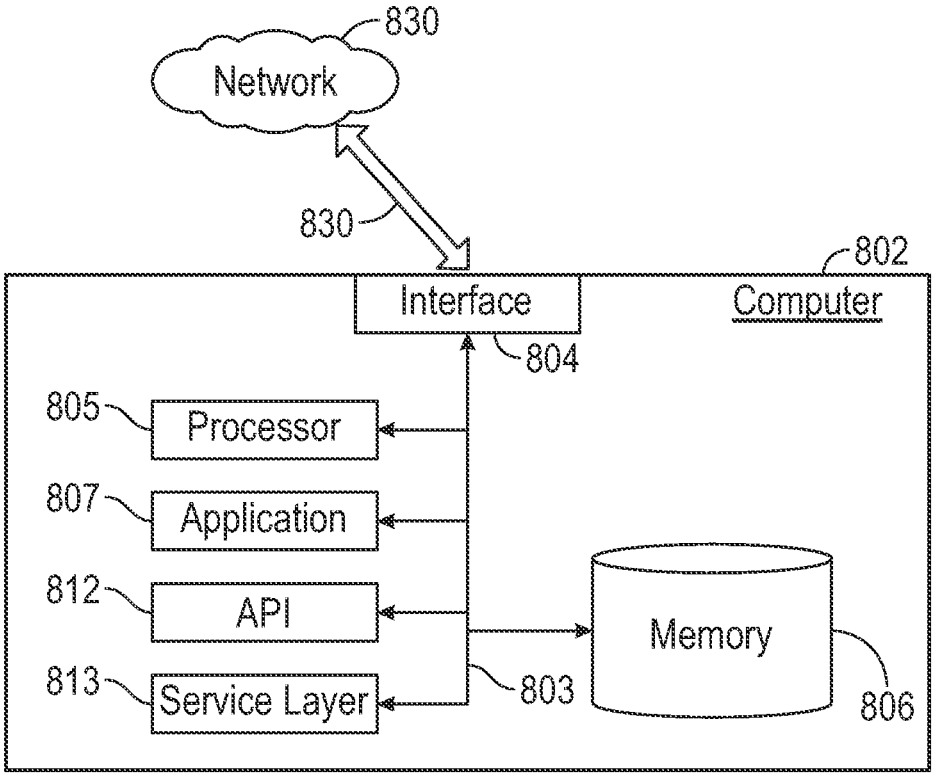
FIG. 8 shows a computer system in accordance with one or more embodiments.

Embodiments may be implemented on a computer system. FIG. 8 is a block diagram of a computer system (802) used to provide computational functionalities associated with described algorithms, methods, functions, processes, flows, and procedures as described in the instant disclosure, according to an implementation. The illustrated computer (802) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (802) may include a computer that includes an input device, such as a keypad, keyboard, touch screen, or other device that can accept user information, and an output device that conveys information associated with the operation of the computer (802), including digital data, visual, or audio information (or a combination of information), or a GUI.

The computer (802) can serve in a role as a client, network component, a server, a database or other persistency, or any other component (or a combination of roles) of a computer system for performing the subject matter described in the instant disclosure. The illustrated computer (802) is communicably coupled with a network (830). In some implementations, one or more components of the computer (802) may be configured to operate within environments, including cloud-computing-based, local, global, or other environment (or a combination of environments).

At a high level, the computer (802) is an electronic computing device operable to receive, transmit, process, store, or manage data and information associated with the described subject matter. According to some implementations, the computer (802) may also include or be communicably coupled with an application server, e-mail server, web server, caching server, streaming data server, business intelligence (BI) server, or other server (or a combination of servers).

The computer (802) can receive requests over network (830) from a client application (for example, executing on another computer (802)) and responding to the received requests by processing the said requests in an appropriate software application. In addition, requests may also be sent to the computer (802) from internal users (for example, from a command console or by other appropriate access method), external or third-parties, other automated applications, as well as any other appropriate entities, individuals, systems, or computers.

Each of the components of the computer (802) can communicate using a system bus (803). In some implementations, any or all of the components of the computer (802), both hardware or software (or a combination of hardware and software), may interface with each other or the interface (804) (or a combination of both) over the system bus (803) using an application programming interface (API) (812) or a service layer (813) (or a combination of the API (812) and service layer (813). The API (812) may include specifications for routines, data structures, and object classes. The API (812) may be either computer-language independent or dependent and refer to a complete interface, a single function, or even a set of APIs. The service layer (813) provides software services to the computer (802) or other components (whether or not illustrated) that are communicably coupled to the computer (802). The functionality of the computer (802) may be accessible for all service consumers using this service layer. Software services, such as those provided by the service layer (813), provide reusable, defined business functionalities through a defined interface. For example, the interface may be software written in JAVA, C++, or other suitable language providing data in extensible markup language (XML) format or other suitable format. While illustrated as an integrated component of the computer (802), alternative implementations may illustrate the API (812) or the service layer (813) as stand-alone components in relation to other components of the computer (802) or other components (whether or not illustrated) that are communicably coupled to the computer (802). Moreover, any or all parts of the API (812) or the service layer (813) may be implemented as child or sub-modules of another software module, enterprise application, or hardware module without departing from the scope of this disclosure.

The computer (802) includes an interface (804). Although illustrated as a single interface (804) in FIG. 8, two or more interfaces (804) may be used according to particular needs, desires, or particular implementations of the computer (802). The interface (804) is used by the computer (802) for communicating with other systems in a distributed environment that are connected to the network (830). Generally, the interface (includes logic encoded in software or hardware (or a combination of software and hardware) and operable to communicate with the network (830). More specifically, the interface (804) may include software supporting one or more communication protocols associated with communications such that the network (830) or interface's hardware is operable to communicate physical signals within and outside of the illustrated computer (802).

The computer (802) includes at least one computer processor (805). Although illustrated as a single computer processor (805) in FIG. 8, two or more processors may be used according to particular needs, desires, or particular implementations of the computer (802). Generally, the computer processor (805) executes instructions and manipulates data to perform the operations of the computer (802) and any algorithms, methods, functions, processes, flows, and procedures as described in the instant disclosure.

The computer (802) also includes a memory (806) that holds data for the computer (802) or other components (or a combination of both) that can be connected to the network (830). For example, memory (806) can be a database storing data consistent with this disclosure. Although illustrated as a single memory (806) in FIG. 8, two or more memories may be used according to particular needs, desires, or particular implementations of the computer (802) and the described functionality. While memory (806) is illustrated as an integral component of the computer (802), in alternative implementations, memory (806) can be external to the computer (802).

The application (807) is an algorithmic software engine providing functionality according to particular needs, desires, or particular implementations of the computer (802), particularly with respect to functionality described in this disclosure. For example, application (807) can serve as one or more components, modules, applications, etc. Further, although illustrated as a single application (807), the application (807) may be implemented as multiple applications (807) on the computer (802). In addition, although illustrated as integral to the computer (802), in alternative implementations, the application (807) can be external to the computer (802).

There may be any number of computers (802) associated with, or external to, a computer system containing computer (802), each computer (802) communicating over network (830). Further, the term "client," "user," and other appropriate terminology may be used interchangeably as appropriate without departing from the scope of this disclosure. Moreover, this disclosure contemplates that many users may use one computer (802), or that one user may use multiple computers (802).

In some embodiments, the computer (802) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (Saas), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A system for a gas lift system in a well having a wellhead, the system comprising:

a tubing disposed in a casing in the well defining a tubing-casing annulus (TCA) in the well;

a TCA valve installed on the wellhead coupled to the tubing and the casing defining a flow path for a fluid flowing from the TCA to the tubing;

a first injection line coupled to the TCA valve configured to inject the fluid into the TCA; and a fixed restriction disposed in a cavity of the TCA valve hydraulically connected to the first injection line, wherein the fixed restriction comprises an orifice plate defining at least four concentric orifices surrounding an aperture comprising a diameter smaller than an inner diameter of the cavity.

2. The system of claim 1, further comprising:

a second injection line disposed in the gas lift system configured to inject a gas into the well.

3. The system of claim 1, wherein the first injection line is made of Nickel Alloy material configured to withstand high pressure and high temperature.

4. The system of claim 1, wherein the fluid is a gas.

5. The system of claim 1, further comprising:

a tubing hanger configured to couple the TCA valve is coupled to the tubing, and a flange configured to couple the TCA valve to the casing.

6. A system for a gas lift system in a well having a wellhead, the system comprising:

a tubing disposed in a casing in the well defining a tubing-casing annulus (TCA) in the well;

a TCA valve installed on the wellhead coupled to the tubing and the casing configured to control a flow of a fluid from the TCA to the tubing;

a first injection line coupled to the TCA valve configured to inject the fluid into the TCA; and a restrictive orifice hydraulically connecting a cavity in the TCA valve to the first injection line, wherein the restrictive orifice comprises an aperture configured to restrict the flow of the fluid through the first injection line;

an emergency shutdown system (ESD) hydraulically connected to the restrictive orifice in the first injection line, wherein the ESD is configured to stop fluid flow in the first injection line, via the TCA valve, when a pressure differential across the restrictive orifice exceeds a predetermined threshold, wherein the ESD comprises a sensor disposed on the first injection line configured to measure a plurality of parameters, the plurality of parameters comprise pressure data, flowrate data, and temperature data.

7. The system of claim 6, further comprising:

a power-operated emergency isolation valve (ZV) disposed in the first injection line configured to shut down a gas supply via a programmable logic controller (PLC) configured to monitor a plurality of parameters, and wherein the gas supply comprises a large pipeline coupled to the ZV, wherein the PLC comprises the ESD.

8. The system of claim 6, wherein the restrictive orifice comprises a pressure sensor configured to measure the pressure differential across the restrictive orifice.

9. The system of claim 7, further comprising:

a check valve disposed between the TCA valve and the ZV in the first injection line, wherein the check valve is configured to direct fluid flow in one direction and prevent backflow.

10. The system of claim 9, wherein the check valve is automatically actuated based on a second pressure differential across the check valve.

11. A method for a gas lift system in a well having a wellhead, the method comprising:

running a tubing inside a casing in the well defining a tubing-casing annulus (TCA);

installing a TCA valve to the wellhead coupled to the tubing and the casing and to a first injection line configured to inject a fluid into the TCA;

opening the TCA valve to flow the fluid from the first injection line to the TCA and into the tubing; and restricting the fluid flow from the first injection line into the TCA valve, via a fixed restriction disposed in a cavity of the TCA valve, wherein restricting the fluid flow comprises using an orifice plate to define an aperture comprising a diameter smaller than an inner diameter of the cavity;

closing the TCA valve to stop fluid flow in the first injection line via an emergency shutdown system (ESD) hydraulically connected to the fixed restriction in the first injection line when a pressure differential across the fixed restriction exceeds a predetermined threshold, wherein the ESD comprises a sensor disposed on the first injection line configured to measure a plurality of parameters, and wherein the plurality of parameters comprise pressure data, flowrate data, and temperature data.

12. The method of claim 11, further comprising:

shutting down a gas supply via a ZV disposed in the first injection line actuated by a programmable logic controller (PLC) configured to monitor the plurality of parameters, and wherein the gas supply comprises a large pipeline coupled to the ZV, wherein the PLC comprises the ESD.

13. The method of claim 11, further comprising:

measuring the pressure differential across the fixed restriction with a pressure sensor coupled to the fixed restriction.

14. The method of claim 12, further comprising:

directing fluid flow in one direction and preventing backflow by disposing a check valve between the TCA valve and the ZV in the first injection line.

15. The method of claim 14, wherein directing fluid flow in one direction and preventing backflow comprises automatically actuating the check valve based on a second pressure differential across the check valve.

16. The method of claim 11, further comprising:

injecting a gas into the well via a second injection line coupled to the wellhead.

17. The method of claim 11, wherein the first injection line is made of Nickel Alloy material configured to withstand high pressure and high temperature.

18. The method of claim 11, wherein the fluid is a gas.

19. The method of claim 11, wherein installing the TCA valve comprises coupling the TCA valve to the tubing via a tubing hanger and coupling the TCA valve to the casing via a flange.

* * * * *